US009617790B2

(12) United States Patent
Samuel

(10) Patent No.: US 9,617,790 B2
(45) Date of Patent: Apr. 11, 2017

(54) DOWNHOLE DRILLING MOTOR AND METHOD OF USE

(71) Applicant: Halliburton Energy Services, Inc., Houston, TX (US)

(72) Inventor: Robello Samuel, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/786,865

(22) PCT Filed: May 23, 2013

(86) PCT No.: PCT/US2013/042500

§ 371 (c)(1),
(2) Date: Oct. 23, 2015

(87) PCT Pub. No.: WO2014/189517

PCT Pub. Date: Nov. 27, 2014

(65) Prior Publication Data

US 2016/0115738 A1 Apr. 28, 2016

(51) Int. Cl.
*E21B 4/02* (2006.01)
*E21B 3/00* (2006.01)

(52) U.S. Cl.
CPC . *E21B 4/02* (2013.01); *E21B 3/00* (2013.01)

(58) Field of Classification Search
CPC ..... E21B 4/02
USPC ..... 175/107
See application file for complete search history.

(56) References Cited

U.S. PATENT DOCUMENTS

| | | | |
|---|---|---|---|
| 2,085,115 | A | 6/1937 | Moineau |
| 3,840,080 | A | 10/1974 | Berryman |
| 4,275,795 | A | 6/1981 | Beimgraben |
| 4,291,723 | A | 9/1981 | Beimgraben |

(Continued)

FOREIGN PATENT DOCUMENTS

| | | |
|---|---|---|
| RU | 2119035 C1 | 9/1998 |
| RU | 2181851 C2 | 4/2002 |

(Continued)

OTHER PUBLICATIONS

International Search Report and Written Opinion mailed Oct. 8, 2013, PCT International Application No. PCT/US2013/042500.

(Continued)

*Primary Examiner* — Giovanna C Wright
(74) *Attorney, Agent, or Firm* — McGuireWoods LLP

(57) ABSTRACT

A downhole drilling motor comprises a first elastomer stator molded to an inner surface of a housing in a drillstring where the first elastomer stator has a first number of lobes. A dual purpose, helical shaped hollow member is positioned within the first elastomer stator, where the dual purpose hollow member has a second number of lobes formed on an external surface to form a first rotor. The second number of lobes is one less than the first number of lobes. A second elastomer stator is adhered to an inner surface of the dual purpose helical shaped hollow member, where the second elastomer stator has a second helical shaped cavity with the second number of lobes. A second helical shaped rotor is positioned within the second helical cavity, and has a third number of lobes one less than the second number of lobes.

10 Claims, 4 Drawing Sheets

(56) References Cited

U.S. PATENT DOCUMENTS

| | | | | |
|---|---|---|---|---|
| 5,407,337 | A | 4/1995 | Appleby | |
| 6,662,110 | B1 | 12/2003 | Bargach | |
| 2006/0243492 | A1 | 11/2006 | Downton | |
| 2009/0169364 | A1 | 7/2009 | Downton | |
| 2012/0132470 | A1 | 5/2012 | Jarvis | |
| 2016/0195087 | A1* | 7/2016 | Downton | E21B 4/02 175/57 |

FOREIGN PATENT DOCUMENTS

| | | | |
|---|---|---|---|
| RU | 2191294 | C2 | 10/2002 |
| RU | 2387877 | C1 | 4/2010 |

OTHER PUBLICATIONS

Russian Office Action date mailed Oct. 19, 2016; Russian Application No. 2015144639/03.

* cited by examiner

DOWNHOLE DRILLING MOTOR AND METHOD OF USE

BACKGROUND OF THE INVENTION

The present disclosure relates generally to the field of drilling wells and more particularly to downhole drilling motors.

In progressive cavity drilling motors, the motor rpm is directly related to the fluid flow rate through the motor. Each motor size is designed to accommodate a range of fluid flow rates. In some downhole drilling scenarios, there is a need for changing the fluid flow rate and/or the rotational speed of bit 150, outside of the design range for the drilling motor in the drill string. A change out of the motor may be required with the attendant removal of the drill string from the wellbore. Such changes are costly in terms of rig time.

DETAILED DESCRIPTION

Figure 1:
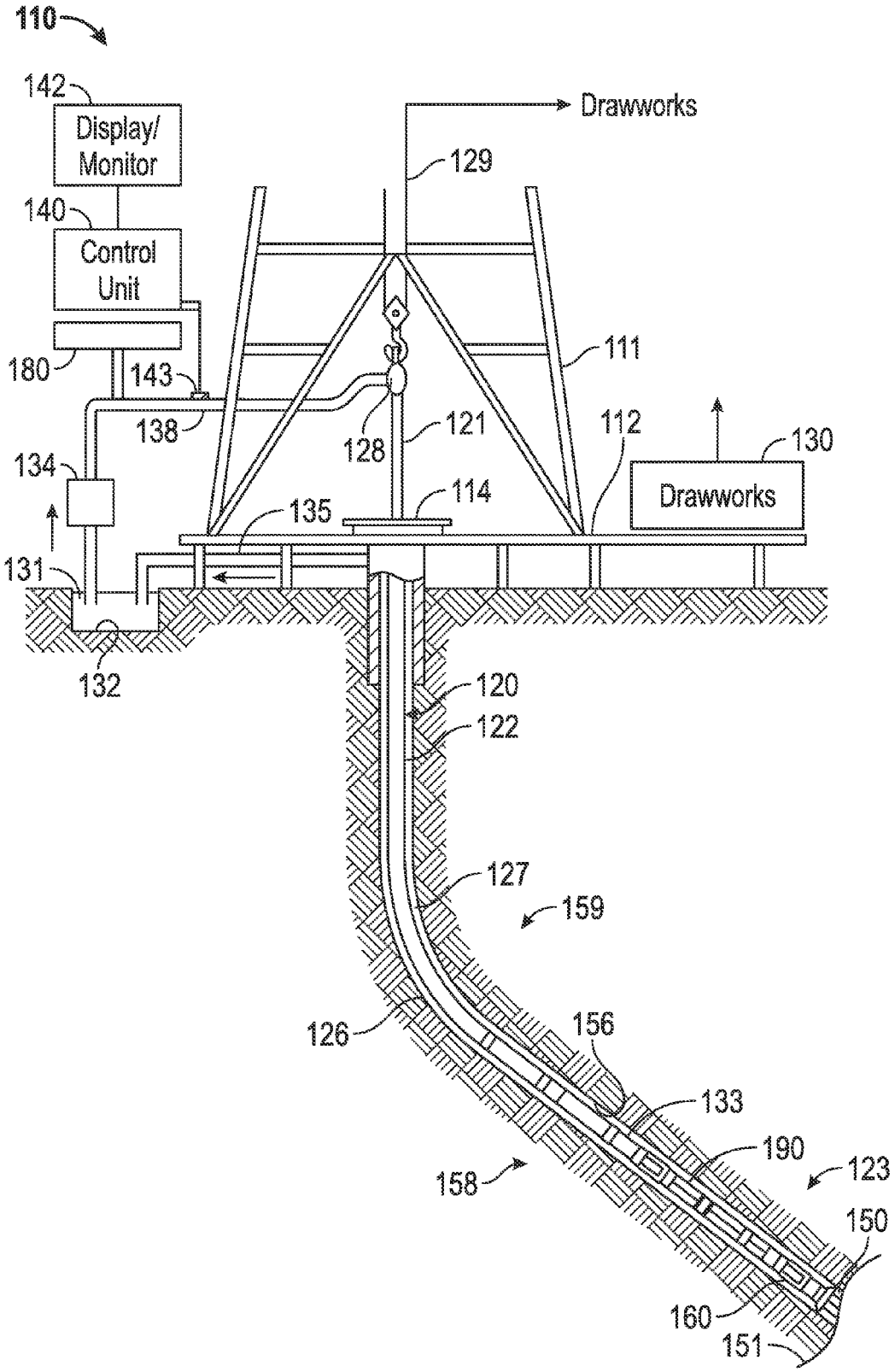
FIG. 1 shows a schematic diagram of a drilling system.

FIG. 1 shows a schematic diagram of a drilling system 110 having a downhole assembly according to one embodiment of the present disclosure. As shown, the system 110 includes a conventional derrick 111 erected on a derrick floor 112, which supports a rotary table 114 that is rotated by a prime mover (not shown) at a desired rotational speed. A drill string 120 that comprises a drill pipe section 122 extends downward from rotary table 114 into a directional borehole 126. Borehole 126 may travel in a three-dimensional path. A drill bit 150 is attached to the downhole end of drill string 120 and disintegrates the geological formation 123 when drill bit 150 is rotated. The drill string 120 is coupled to a drawworks 130 via a kelly joint 121, swivel 128 and line 129 through a system of pulleys (not shown). During the drilling operations, drawworks 130 is operated to control the weight on bit 150 and the rate of penetration of drill string 120 into borehole 126. The operation of drawworks 130 is well known in the art and is thus not described in detail herein.

During drilling operations a suitable drilling fluid (also referred to in the art as "mud") 131 from a mud pit 132 is circulated under pressure through drill string 120 by a mud pump 134. Drilling fluid 131 passes from mud pump 134 into drill string 120 via fluid line 138 and kelly joint 121. Drilling fluid 131 is discharged at the borehole bottom 151 through an opening in drill bit 150. Drilling fluid 131 circulates uphole through the annular space 127 between drill string 120 and borehole 126 and is discharged into mud pit 132 via a return line 135. Preferably, a variety of sensors (not shown) are appropriately deployed on the surface according to known methods in the art to provide information about various drilling-related parameters, such as fluid flow rate, weight on bit, hook load, etc.

In one example embodiment of the present disclosure, a bottom hole assembly (BHA) 159 may comprise a measurement while drilling (MWD) system 158 comprising various sensors to provide information about the formation 123 and downhole drilling parameters. BHA 159 may be coupled between the drill bit 150 and the drill pipe 122.

MWD sensors in BHA 159 may include, but are not limited to, a sensors for measuring the formation resistivity near the drill bit, a gamma ray instrument for measuring the formation gamma ray intensity, attitude sensors for determining the inclination and azimuth of the drill string, and pressure sensors for measuring drilling fluid pressure downhole. The above-noted sensors may transmit data to a downhole telemetry transmitter 133, which in turn transmits the data uphole to the surface control unit 140. In one embodiment a mud pulse telemetry technique may be used to communicate data from downhole sensors and devices during drilling operations. A transducer 143 placed in the mud supply line 138 detects the mud pulses responsive to the data transmitted by the downhole transmitter 133. Transducer 143 generates electrical signals in response to the mud pressure variations and transmits such signals to a surface control unit 140. Surface control unit 140 may receive signals from downhole sensors and devices via sensor 143 placed in fluid line 138, and processes such signals according to programmed instructions stored in a memory, or other data storage unit, in data communication with surface control unit 140. Surface control unit 140 may display desired drilling parameters and other information on a display/monitor 142 which may be used by an operator to control the drilling operations. Surface control unit 140 may contain a computer, a memory for storing data, a data recorder, and other peripherals. Surface control unit 140 may also have drilling, log interpretation, and directional models stored therein and may process data according to programmed instructions, and respond to user commands entered through a suitable input device, such as a keyboard (not shown).

In other embodiments, other telemetry techniques such as electromagnetic and/or acoustic techniques, or any other suitable technique known in the art may be utilized for the purposes of this invention. In one embodiment, hard-wired drill pipe may be used to communicate between the surface and downhole devices. In one example, combinations of the techniques described may be used. In one embodiment, a surface transmitter receiver 180 communicates with downhole tools using any of the transmission techniques described, for example a mud pulse telemetry technique. This may enable two-way communication between surface control unit 140 and the downhole tools described below.

In one embodiment, a downhole drilling motor 190 is included in drill string 120. Downhole drilling motor 190 may be a fluid driven, progressive cavity drilling motor of the Moineau type that uses drilling fluid to rotate an output shaft that is operatively coupled to drill bit 150. These devices are well known in the art and have a helical rotor within the cavity of a stator that is connected to the housing of the motor. As the drilling fluid is pumped down through the motor, the fluid rotates the rotor. In some embodiments, the rotation of bit 150 may be the combination of rotation of drill string 120 and the rotation of the motor shaft. In progressive cavity drilling motors, the motor rpm is directly related to the fluid flow rate through the motor. Each motor size is designed to accommodate a range of fluid flow rates. In some downhole drilling scenarios, there is a need for changing the fluid flow rate and/or the rotational speed of bit 150, outside of the design range for the drilling motor in the drill string. A change out of the motor may be required with the attendant removal of the drill string from the wellbore. Such changes are costly in terms of rig time.

Figure 2:
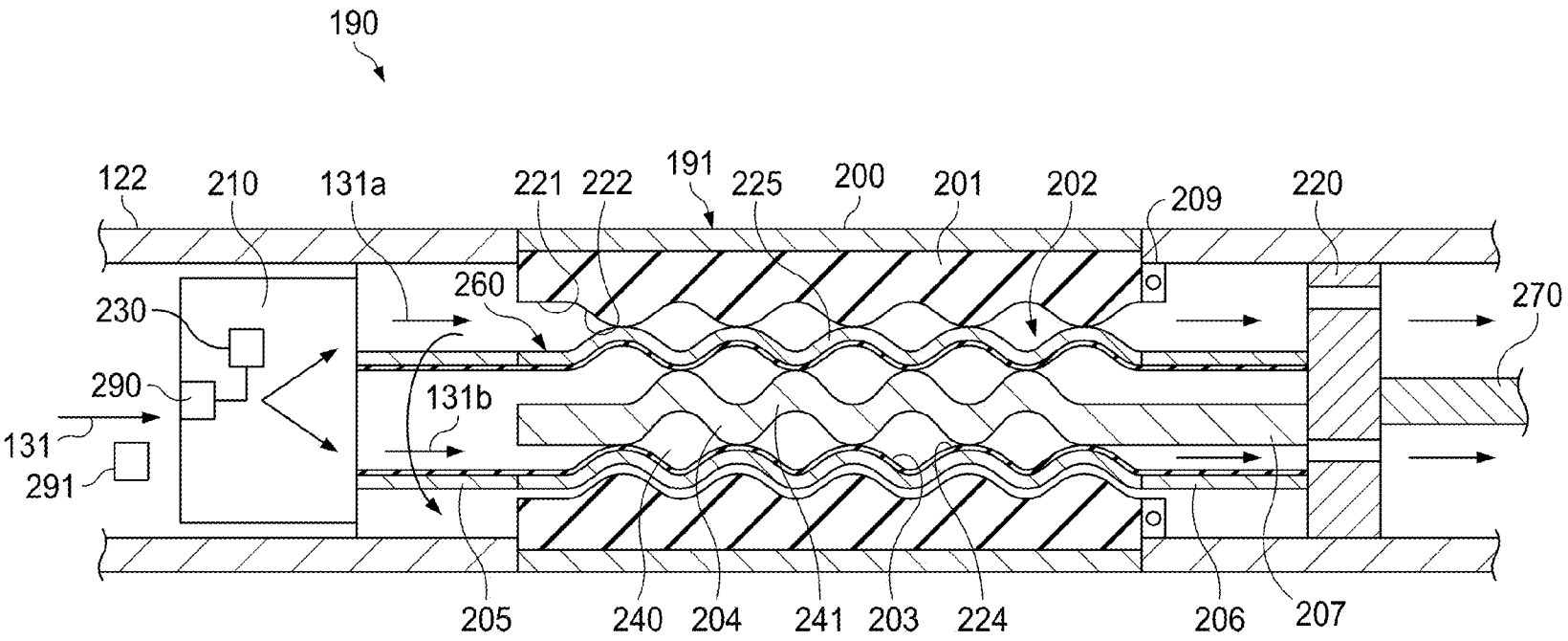
FIG. 2 shows a diagram of one embodiment of a downhole motor.

In one embodiment of the present disclosure, see FIG. 2, drilling motor 190 comprises a power section 191 that provides two different rotor/stator combinations. Housing 200 is connected in drill string 122. An elastomer stator 201 is adhered to the inner surface of housing 200. Stator 201 has an inner helically shaped cavity 221 with a first number N1 of lobes 222 formed along the cavity 221. A dual purpose, helical shaped, hollow shaft 202 is positioned in the cavity 221. The dual purpose hollow shaft 202 is formed with a second number N2 of lobes 225 on an outer surface to form a first rotor 260, where N2=N1−1. There is an interference seal between the stator lobes 222 of the first stator 201 and the lobes 225 of the first rotor 260. When drilling fluid 131A flows through the passages between the first stator 201 and the first rotor 260, rotor 260 is forced to rotate relative to first stator 201. Dual purpose hollow shaft 202 may be formed from a metallic material, for example, steel, stainless steel, nickel based alloys, aluminum, and titanium.

The dual purpose hollow shaft 202 also has a second elastomer stator 203 adhered on an inner surface thereof, forming a second cavity 240, where the second elastomer stator has a third number N3 of lobes 224 where N3 is the same as the number of lobes N2 of the first rotor 260. Similarly, there is a second helical shaped rotor 204 positioned within cavity 240 of second stator 203. Second rotor 204 has a fourth number N4 of lobes 241 where N4=N3−1. There is an interference seal between the stator lobes 224 of the second stator 203 and the lobes 241 of the second rotor 204. When drilling fluid 131B flows through the passages between the second stator 203 and the second rotor 204, second rotor 260 is forced to rotate relative to second stator 203. Second rotor 204 may be formed from a metallic material, for example, steel, stainless steel, nickel based alloys, aluminum, and titanium.

Drilling fluid 131 may be diverted to one of: first flow cavity 221, second flow cavity 240, and both first flow cavity 221 and second flow cavity 240 simultaneously, by a controllable flow selector 210 in the upstream flow passage. Dual purpose hollow shaft 202 has a flexible conduit 205 that extends form the end of shaft 202 to controllable flow selector 210. Flexible conduit 205 may be coupled to controllable flow selector 210 by a rotating fluid coupling (not shown). This allows conduit 205 to rotate with shaft 202 while maintaining a flow separation between cavities 221 and 240, when desired. A first controller 230 may be operably connected to flow selector 210 to control the flow selection. In one embodiment, controller 230 may receive instructions from the surface via telemetry from the surface as described above. In another example, first controller 230 may receive instructions via a flowable device, for example a radio frequency identification device (RFID) 291 that is inserted in the flow stream. RFID 291 may contain instructions that are transmitted to RFID receiver 290 operably connected to first controller 230. RFID's are known in the art and are not described herein in detail. Controllable flow selector 210 may comprise internal flow channeling through the use of sliding sleeves and/or actuatable valve elements to suitably divert the fluid flow, as directed. This capability provides for a wider range of suitable RPM and bit torques over a wider range of fluid flow rates than would be possible with a single configuration drilling motor.

Figure 3A:
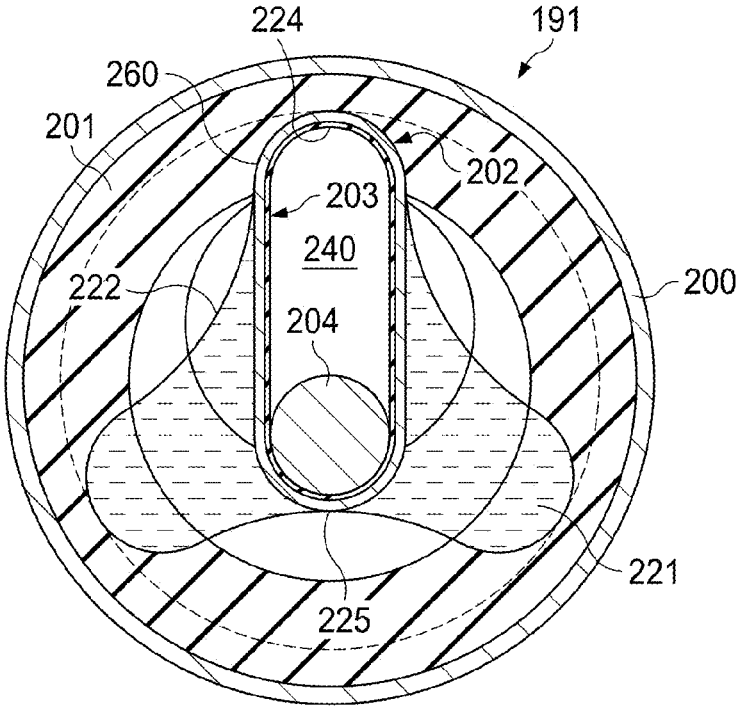
FIG. 3A shows one example of fluid flow through a power section of a downhole motor.
Figure 3B:
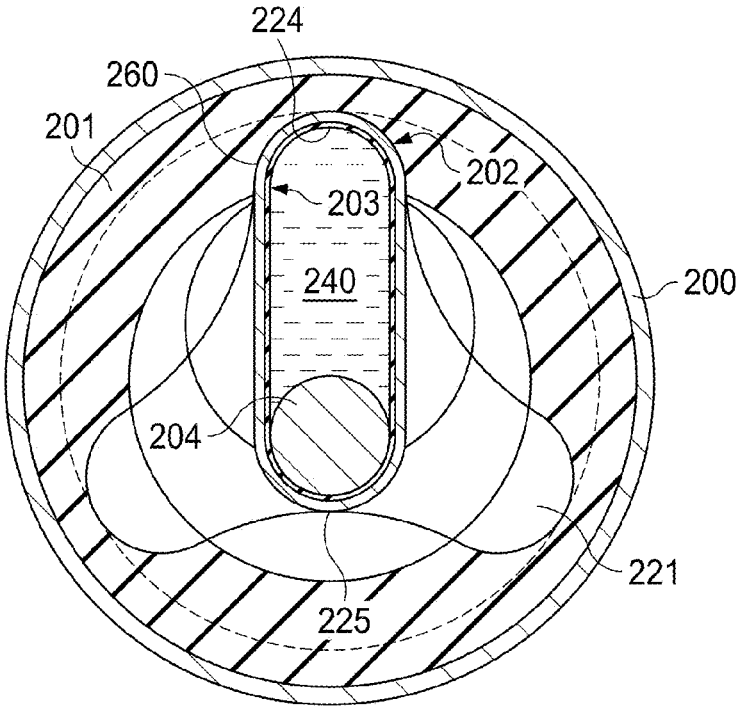
FIG. 3B shows another example of fluid flow through a power section of a downhole motor.

FIGS. 3A and 3B show axial views of power section 190 with the fluid flowing through the two different flow cavities. FIG. 3A demonstrates flow through first flow cavity 221. Here, the first stator 201 has three lobes 222, and the first rotor 260 has two lobes 225. Fluid flows only through first flow cavity 221, and first rotor 260 rotates with respect to first stator 201 at a rotational speed of RPM1. In FIG. 3B, second rotor 204 has a single lobe while second stator 203 has 2 lobes. Fluid flows only through second flow cavity 240, and only second rotor 204 rotates with respect to second stator 203 at a rotational speed RPM2. Second stator 203 does not rotate with respect to housing 200. When fluid flows through both flow cavities 221, 240 each rotor 260, 204 rotates with respect to its related stator 201, 203. This causes rotor 204 to rotate at an additive speed of RPM3=RPM1+RPM2.

Figure 4:
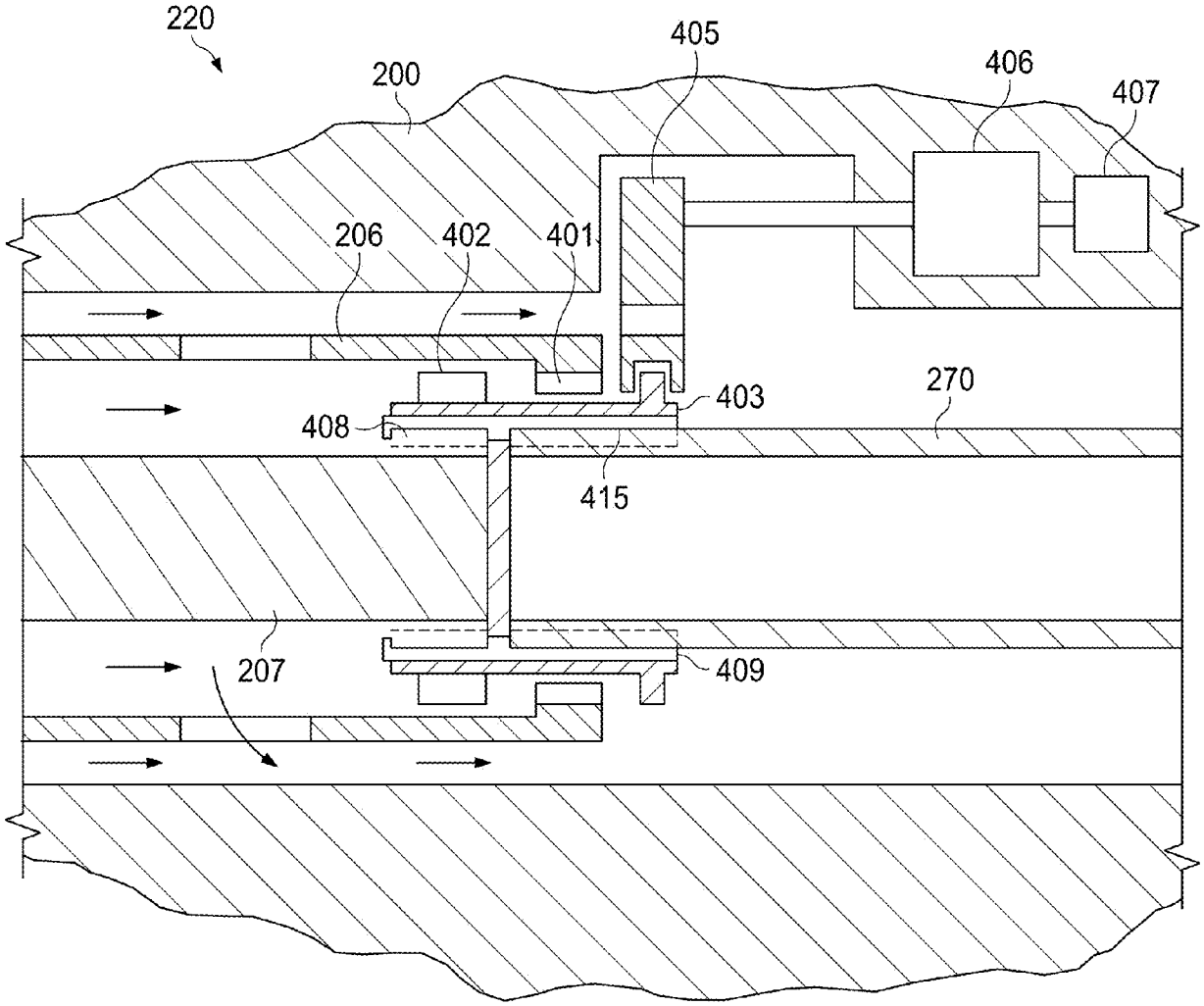
FIG. 4 shows an example of a clutch section of a downhole motor.

Flexible shafts 206 and 207 couple first rotor 260 and second rotor 204, respectively, through a controllable clutch 220 to output shaft 270 that is operably coupled to bit 150. In one example, see FIG. 4, controllable clutch 220 comprises a positive engagement clutch, sometimes referred to as a dog clutch. As shown in FIG. 4, flexible shafts 206 and 207 are selectably engaged with engagement collar 403. Engagement collar 403 has an internal spline 409 that is engageable with spline 415 on the end of output shaft 270. In addition, engagement collar 403 has an external spline formed on an end closes to power section 191. Flexible shaft 207 has an external spline 408 formed thereon. Flexible shaft 206 has an internal spline 401 formed thereon. By controllably axially moving engagement collar 403, either shaft 206 or shaft 207 may be selectably engaged with output shaft 270 to drive drill bit 150.

Engagement collar 403 is axially movable by extension and retraction of yoke 405. Yoke 405 is coupled to linear actuator 406 that is operably connected to second controller 407. Controller 407 may be in data communication with first controller 290 to coordinate the operation of flow selector 210 and clutch 220 to provide the appropriate output to drill bit 150. Communication may be by any short hop communication system known on the art, for example, acoustic communication, radio frequency communication, and hard wired communication.

In one embodiment, a conductive coil may be placed around the inner circumference of housing 200 such that the rotation of first rotor 260 and/or second rotor 204 induce a voltage that may be used for powering downhole controllers 407 and/or 290 and other downhole tools and sensors.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

The invention claimed is:

1. A downhole drilling motor comprising:

a tubular housing in a drillstring;

a first elastomer stator molded to an inner surface of the housing, the first elastomer stator having a first helical shaped cavity with a first number of lobes formed therein;

a dual purpose, helical shaped hollow member positioned within the first elastomer stator, the dual purpose hollow member having a second number of lobes formed on an external surface to form a first rotor where the second number of lobes of the first rotor is one less than the first number of lobes of the first stator;

a second elastomer stator molded to an inner surface of the dual purpose helical shaped hollow member, the second elastomer stator having a second helical shaped cavity with the second number of lobes; and a second helical shaped rotor positioned within the second helical cavity, the second helical shaped rotor having a third number of lobes wherein the third number of lobes is one less than the second number of lobes;

a flow selector in a top end of the tubular housing, the flow selector operable to direct drilling fluid through at least one of: the first helical shaped cavity; the second helical shaped cavity; and both the first helical shaped cavity and the second helical shaped cavity; and a first flexible shaft operably connected to a lower end of the helical shaped hollow member, and a second flexible shaft operably connected to a lower end of the helical shaped second rotor.

2. The downhole drilling motor of claim 1 further comprising a controllable clutch operably coupled to the first flexible shaft and the second flexible shaft, the clutch actuatable to operably couple at least one of the first flexible shaft and the second flexible shaft to an output shaft.

3. The downhole drilling motor of claim 2 further comprising at least one controller operably connected to at least one of the flow selector and the clutch.

4. The downhole drilling motor of claim 3 further comprising at least one radio frequency identification device receiver operably coupled to the at least one controller.

5. The downhole drilling motor of claim 1 further comprising a conductive coil positioned around an inner circumference of the housing to generate electricity when at least one of the first rotor and the second rotor rotates.

6. A method of drilling a well with a downhole drilling motor comprising:

positioning a tubular housing in a drillstring;

molding a first elastomer stator to an inner surface of the housing, the first elastomer stator having a first helical shaped cavity with a first number of lobes formed therein;

positioning a dual purpose, helical shaped hollow member within the first elastomer stator, the dual purpose hollow member having a second number of lobes formed on an external surface to form a first rotor where the second number of lobes of the first rotor is one less than the first number of lobes of the first stator;

molding a second elastomer stator to an inner surface of the dual purpose helical shaped hollow member, the second elastomer stator having a second helical shaped cavity with the second number of lobes;

positioning a second helical shaped rotor within the second helical cavity, the second helical shaped rotor having a third number of lobes wherein the third number of lobes is one less than the second number of lobes;

directing a drilling fluid through at least one of: the first helical shaped cavity; the second helical shaped cavity; and both the first helical shaped cavity and the second helical shaped cavity, to rotate at least one of the first rotor and the second rotor; and operably connecting a first flexible shaft to a lower end of the helical shaped hollow member, and a second flexible shaft to a lower end of the helical shaped second rotor.

7. The method of claim 6 further comprising operably coupling a controllable clutch to the first flexible shaft and the second flexible shaft, the clutch actuatable to operably couple at least one of the first flexible shaft and the second flexible shaft to an output shaft.

8. The method of claim 7 further comprising operably controlling at least one of the flow selector and the clutch.

9. The method of claim 8 further comprising operating at least one of the flow selector and the clutch according to instructions received from at least one radio frequency identification device transported in the wellbore.

10. The method of claim 6 further comprising generating electrical power from a conductive coil positioned around an inner circumference of the housing when at least one of the first rotor and the second rotor rotates.

* * * * *